US011341874B2

(12) United States Patent
Burke

(10) Patent No.: US 11,341,874 B2
(45) Date of Patent: May 24, 2022

(54) FOLDABLE OUTDOOR ORNAMENT

(71) Applicant: Rebecca Burke, Homer Glen, IL (US)

(72) Inventor: Rebecca Burke, Homer Glen, IL (US)

( * ) Notice: Subject to any disclaimer, the term of this patent is extended or adjusted under 35 U.S.C. 154(b) by 0 days.

(21) Appl. No.: 17/225,303

(22) Filed: Apr. 8, 2021

(65) Prior Publication Data

US 2021/0319729 A1 Oct. 14, 2021

Related U.S. Application Data

(60) Provisional application No. 63/006,773, filed on Apr. 8, 2020.

(51) Int. Cl.
*G09F 15/00* (2006.01)

(52) U.S. Cl.
CPC ..... *G09F 15/0062* (2013.01); *G09F 15/0018* (2013.01)

(58) Field of Classification Search
CPC ..... G09F 15/0062
USPC ..... 40/607.06
See application file for complete search history.

(56) References Cited

U.S. PATENT DOCUMENTS 3,231,994 A * 2/1966 Cyrus ..... E01F 9/688 40/610
4,837,958 A * 6/1989 Radovich ..... G09F 1/08 248/237
5,566,483 A * 10/1996 Ogren ..... G09F 13/08 40/564
6,546,654 B1 4/2003 Henson
7,520,075 B1 * 4/2009 Clark ..... G09F 7/06 40/607.03
9,003,683 B1 4/2015 Feliciano et al.
10,600,343 B1 * 3/2020 Javaheri ..... G09F 15/0062
2004/0128888 A1 * 7/2004 Payan ..... G09F 21/048 40/610
2006/0117626 A1 6/2006 Cheng
2006/0225331 A1 * 10/2006 Evans ..... G09F 1/06 40/600
2007/0119492 A1 5/2007 Zheng
2007/0165397 A1 * 7/2007 Niskanen ..... B44C 5/00 362/145
2007/0261280 A1 11/2007 Rastegar
2009/0193692 A1 * 8/2009 Lipczynski ..... G09F 1/10 40/1
2012/0065005 A1 * 3/2012 Sanllehi ..... G09F 19/12 473/478

(Continued)

*Primary Examiner* — Gary C Hoge
(74) *Attorney, Agent, or Firm* — Boudwin Intellectual Property; Daniel Boudwin

(57) ABSTRACT

A foldable outdoor ornament includes a first panel and a second panel connected via one or more hinges. The first and second panels can fold between a folded position for storage and an open position for use. Brackets are affixed to a rear side of the first panel and a rear side of the second panel. Each bracket includes an upper leg attached to a rear side of one of the first panel or second panel and a lower leg extending perpendicularly outwardly from the rear side of one of the first panel or the second panel. The lower leg of each bracket includes an aperture. A stake is removably secured within each aperture, such that the ornament can be secured to the ground in the open position. The ornament resembles a traditional greeting card such as a birthday card and includes surfaces adapted for users to write messages thereon.

12 Claims, 5 Drawing Sheets

(56) References Cited

U.S. PATENT DOCUMENTS

| | | | | |
|---|---|---|---|---|
| 2013/0050060 | A1* | 2/2013 | Ranger | G09F 15/0062 345/1.1 |
| 2018/0201183 | A1* | 7/2018 | Clay | B60Q 1/2615 |

* cited by examiner

FOLDABLE OUTDOOR ORNAMENT

CROSS REFERENCE TO RELATED APPLICATIONS

This application claims the benefit of U.S. Provisional Patent Application No. 63/006,773 filed on Apr. 8, 2020. The above identified patent application is herein incorporated by reference in its entirety to provide continuity of disclosure.

BACKGROUND OF THE INVENTION

The present invention relates to an outdoor display ornament. More specifically, the present invention provides an outdoor display ornament that is adapted to resemble a traditional greeting card, with surfaces adapted for users to write messages with dry erase markers or similar writing implements.

Many households enjoy decorating their yard with various ornaments and decorative displays. Particularly during holidays such as Christmas, it is very common to see many homes with temporary decorations and ornaments set up around their property. Many different types of ornaments exist for people to customize their outdoor displays. Some of these ornaments and decorations are large and bulky, causing them to be difficult to set up and tear down. These ornaments and outdoor display items are often difficult to maneuver and store when not in use, since they take up large amounts of space.

Another drawback to many outdoor displays and ornaments is that they lack interactivity. Many ornaments and displays provide visual enjoyment but are limited to that one mode of interactivity. Some individuals may desire to have an ornament or display that can provide additional fun by way of physical interactivity. In view of the above, the present invention provides a foldable outdoor ornament that is adapted to resemble a traditional greeting card. Such a foldable outdoor ornament is adapted to provide individuals with the ability to write messages and create their own custom artwork, just as they would be able to with a traditional greeting card. The foldable outdoor ornament has the added benefit of being able to fold up to a compact configuration that takes up less space when the device is being transported or is in storage.

In light of the outdoor decorative ornaments and devices disclosed in the known art, it is submitted that the present invention substantially diverges in design elements from the prior art and consequently it is clear that there is a need in the art for an improvement to existing outdoor ornaments and displays, particularly with regards to improving the physical interactivity individuals may experience with the outdoor ornament. In this regard, the present invention substantially fulfills these needs.

SUMMARY OF THE INVENTION

In view of the foregoing disadvantages inherent in the known types of outdoor ornaments and decorations now present in the prior art, the present invention provides a new foldable outdoor ornament wherein the same can be utilized for providing convenience for the user when creating a decorative display that resembles a traditional greeting card, which includes writing surfaces akin to a traditional greeting card.

The foldable outdoor ornament, generally includes a first panel and a second panel. One or more hinges connect an interior edge of the first panel to an interior edge of the second panel. Wherein the first panel and the second panel are configured to move between a folded position and an open position. In the open position, the foldable outdoor ornament can be set up for continued use. In the folded position, the foldable outdoor ornament becomes more compact for easier transportation or storage.

Brackets are affixed to a rear side of the first panel and a rear side of the second panel. Each bracket includes an upper leg attached to one of the first panel or second panel and a lower leg extending perpendicularly outwardly from one of the rear side of the first panel or the rear side of the second panel. Each lower leg of each bracket includes an aperture. Each bracket aperture is configured to receive a stake therethrough, such that the stake is removably secured within the aperture of the lower leg of one of the plurality of brackets. The stake includes a pointed lower end that extends into the ground, securing the foldable outdoor ornament within the ground in the open position for use. Individuals may write on the interior surfaces of the first and second panels, similar to a traditional greeting card. In this way, individuals may customize their ornament with messages, imagery, and other temporary indicia.

One object of the present invention is to provide a foldable outdoor ornament that can fold up to a compact position for better storage and transportation options.

Another object of the present, invention is to provide a foldable outdoor ornament that includes lights or other electronic elements.

A further object of the present invention is to provide a foldable outdoor ornament that includes additional fasteners for customizing the foldable outdoor ornament with additional display attachments.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
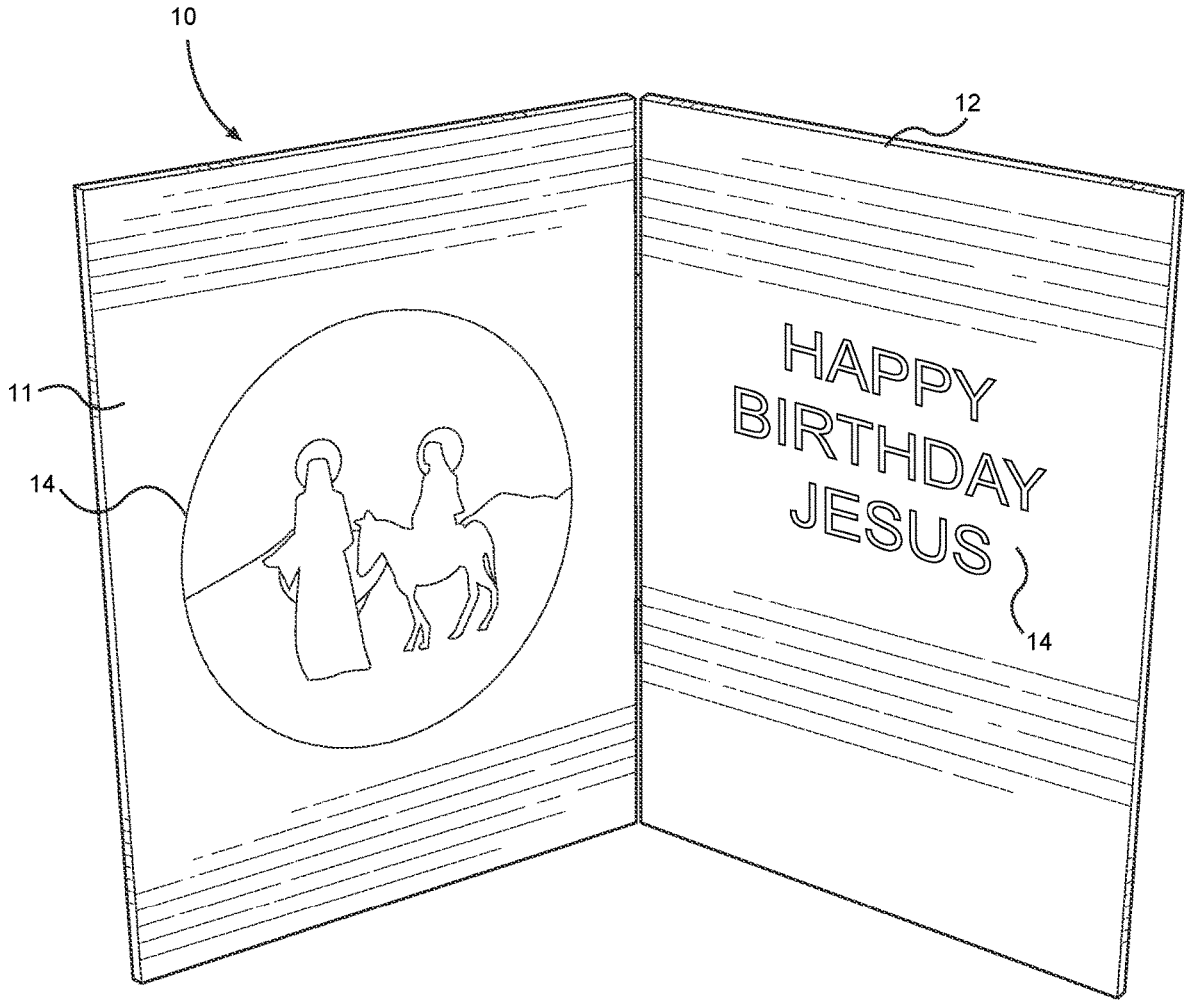
FIG. 1 shows a front perspective view of an embodiment of the foldable outdoor ornament in the open position.

Reference is made herein to the attached drawings. Like reference numerals are used throughout the drawings to depict like or similar elements of foldable outdoor ornament. For the purposes of presenting a brief and clear description of the present invention, the preferred embodiment will be discussed as used for providing a foldable outdoor ornament that is adapted to resemble a traditional greeting card such as a birthday card. The figures are intended for representative purposes only and should not be considered to be limiting in any respect.

Referring now to FIG. 1, there is shown a front perspective view of an embodiment of the foldable outdoor ornament in the open position. The foldable outdoor ornament includes a first, panel 11 affixed to a second panel 12. Each panel 11, 12 can include permanent indicia 14 on their respective interior faces. Further, the first panel 11 and the second panel 12 are shown to be rectangular in shape, and also shown to be identical in size and dimension. In this way, the assembled first and second panels 11, 12 are adapted to resemble a traditional folding greeting card.

Figure 2:
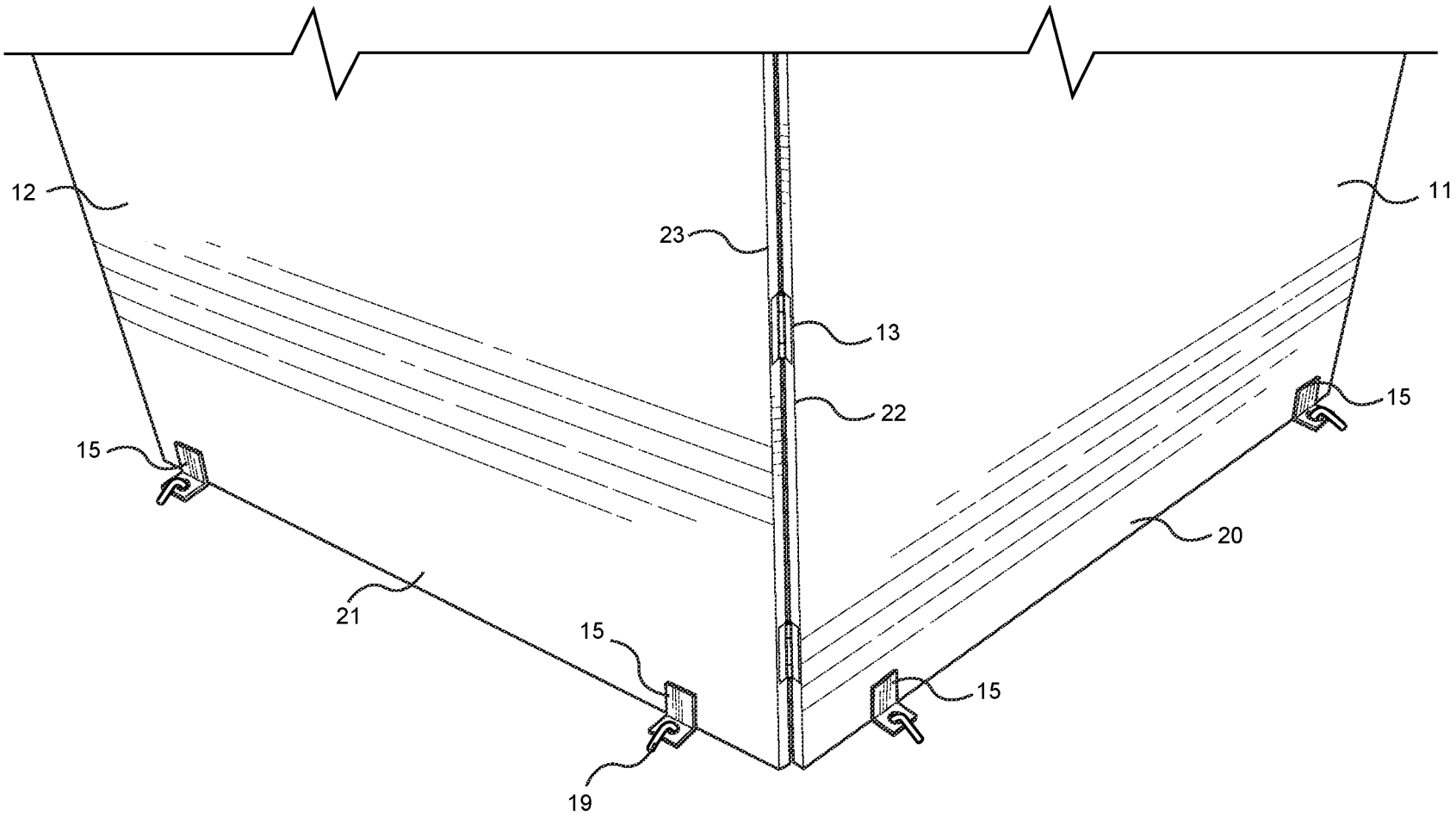
FIG. 2 shows a rear perspective view of an embodiment of the foldable outdoor ornament in the open position.

Referring now to FIG. 2, there is shown a rear perspective view of an embodiment of the foldable outdoor ornament in the open position. One or more hinges 13 connect an Interior edge 22 of the first panel 11 to an interior edge 23 of the second panel. In the shown embodiment, multiple hinges 13 are utilized for maintaining a stable and secure connection between the first and second panels 11, 12. The hinges 13 allow the first panel 11 and the second panel 12 to move between a folded position for storage or transportation, and an open position for installation and use.

The foldable outdoor ornament further includes a plurality of brackets 15 affixed to a rear side 20 of the first panel 11 and a rear side 21 of the second panel 12. The brackets 15 are utilized to secure the foldable outdoor ornament via stakes 19 when the foldable outdoor ornament is unfolded and installed. The stakes 19 can insert into the ground to secure the foldable outdoor ornament in a desired position when it is deployed for use. In the shown embodiment, each panel includes a pair of brackets 15, which provides additional anchor points for better securement and stability when the foldable outdoor ornament is installed in its unfolded configuration.

Figure 3:
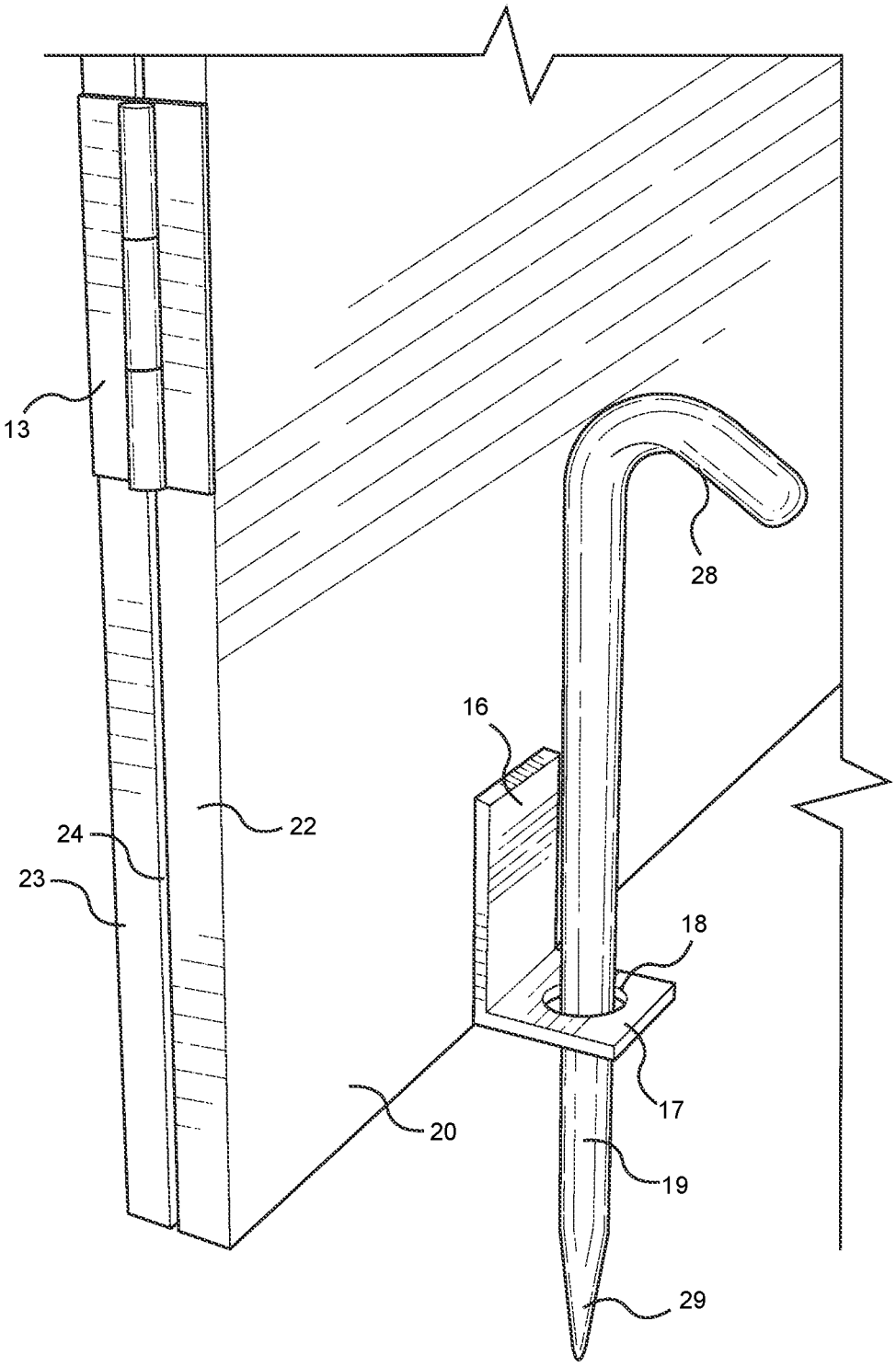
FIG. 3 shows a rear perspective view of an embodiment of the foldable outdoor ornament in the closed position.

Referring now to FIG. 3, there is shown a rear perspective view of an embodiment of the foldable outdoor ornament in the closed position. In the shown embodiment, each bracket 15 includes an upper leg 16 attached to one of the first panel 11 or second panel 12 and a lower leg 17 extending perpendicularly outwardly from one of the rear side 20 of the first panel 11 or the rear side 21 of the second panel 12. Each lower leg 17 includes an aperture 18 that is sized to removably receive the stake 19 therethrough. In the illustrated embodiment, the stake 19 includes a pointed lower end 29 for better ground insertion, and an upper angled member 28 that extends outwardly and downwardly with respect to the pointed lower end 29. This defines a retainer element that extends overtop the lower leg 17 of the bracket 15 when the stake 19 is fully inserted into the ground through the aperture 18. In this way, the stake 19 can more effectively secure the device in place during use.

In the illustrated embodiment, the foldable outdoor ornament is capable of a complete fold to a compact folded configuration via the hinges 13. As shown in FIG. 3, when in the fully folded position, a continuous gap 24 is defined between the inner edge 22 of the first panel 11 and the inner edge 23 of the second panel 12. The continuous gap prevents the two panels from contacting one another when in the folded position and thus prevents unwanted damage to each panel occurring when transport or storing the foldable outdoor ornament in the folded configuration.

Figure 4:
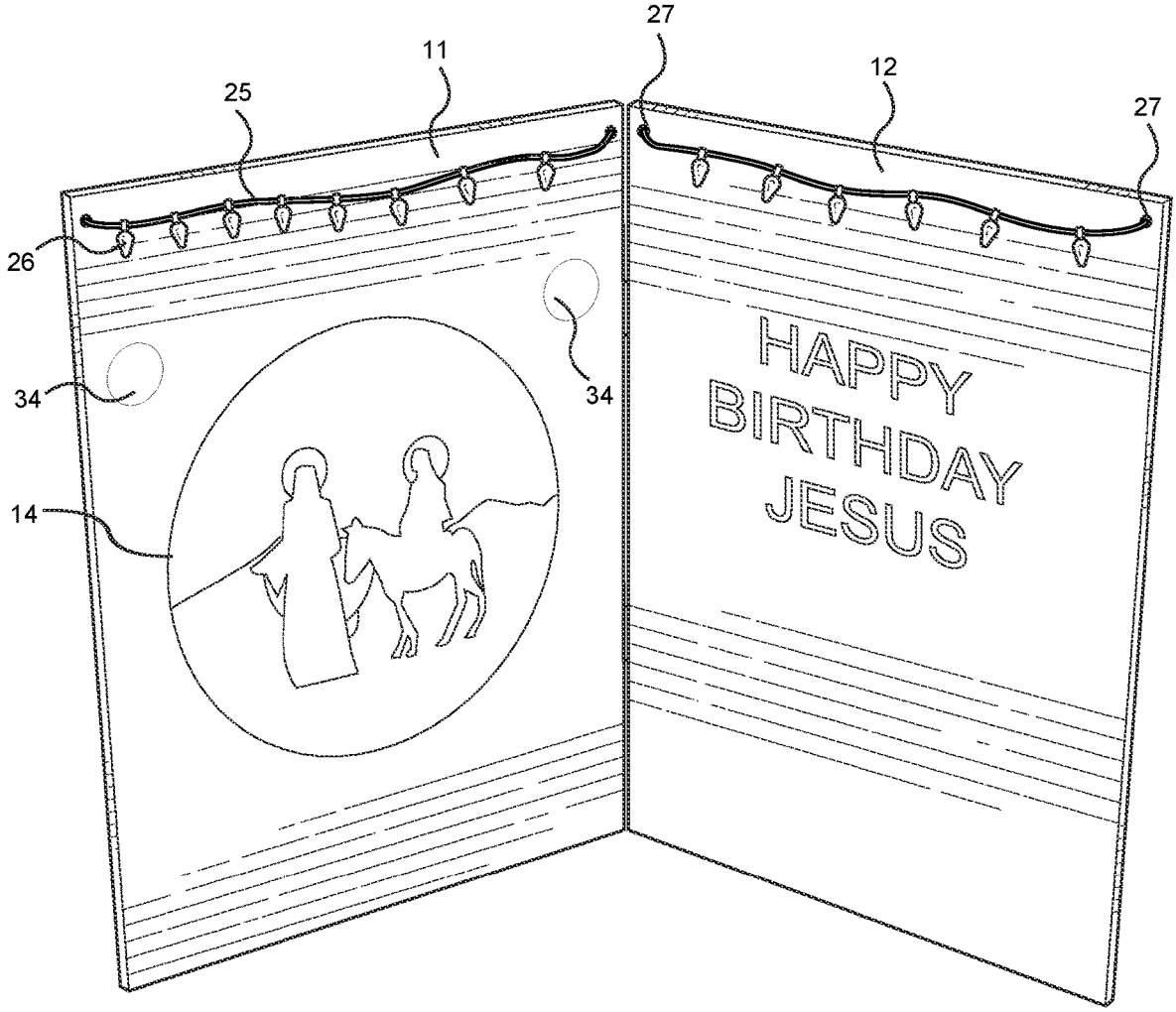
FIG. 4 shows a front perspective view of an alternate embodiment of the foldable outdoor ornament in the open position.

Referring now to FIG. 4, there is shown a front perspective view of an alternate embodiment, of the foldable outdoor ornament in the open position. In some embodiments, the foldable outdoor ornament includes electronic features, such as a light string 25 having a plurality of individual lights 26, for example. In the shown embodiment, the light string 25 extends through apertures 27 on each panel in order to secure the lights thereto. The individual lights 26 may be powered via a power source such as a battery, a wall outlet, or the like. In the illustrated embodiment, the light string 25 extends along an upper edge of each of the first panel 11 and the second panel 12, from an exterior edge of the first panel 11 to an exterior edge of the second panel 12. In addition to providing further visual improvements, this allows the lights 25 to illuminate the other elements of the outdoor display for maximum visibility.

The illustrated embodiment includes additional fasteners 34 attached to either the first or second panels 11, 12 for further customizing the foldable outdoor ornaments. In one embodiment, the fastener 34 includes a magnet for attaching magnetic accessory items to the foldable outdoor ornament. In another embodiment, the fastener includes a clip or a hook for hanging objects, such as a Christmas tree ornament, as one example. The fastener can also include hook and loop or adhesive material for attaching accessories. Along with the permanent indicia 14, this allows users to customize the overall appearance of their outdoor display ornament to suit their personal tastes.

Figure 5:
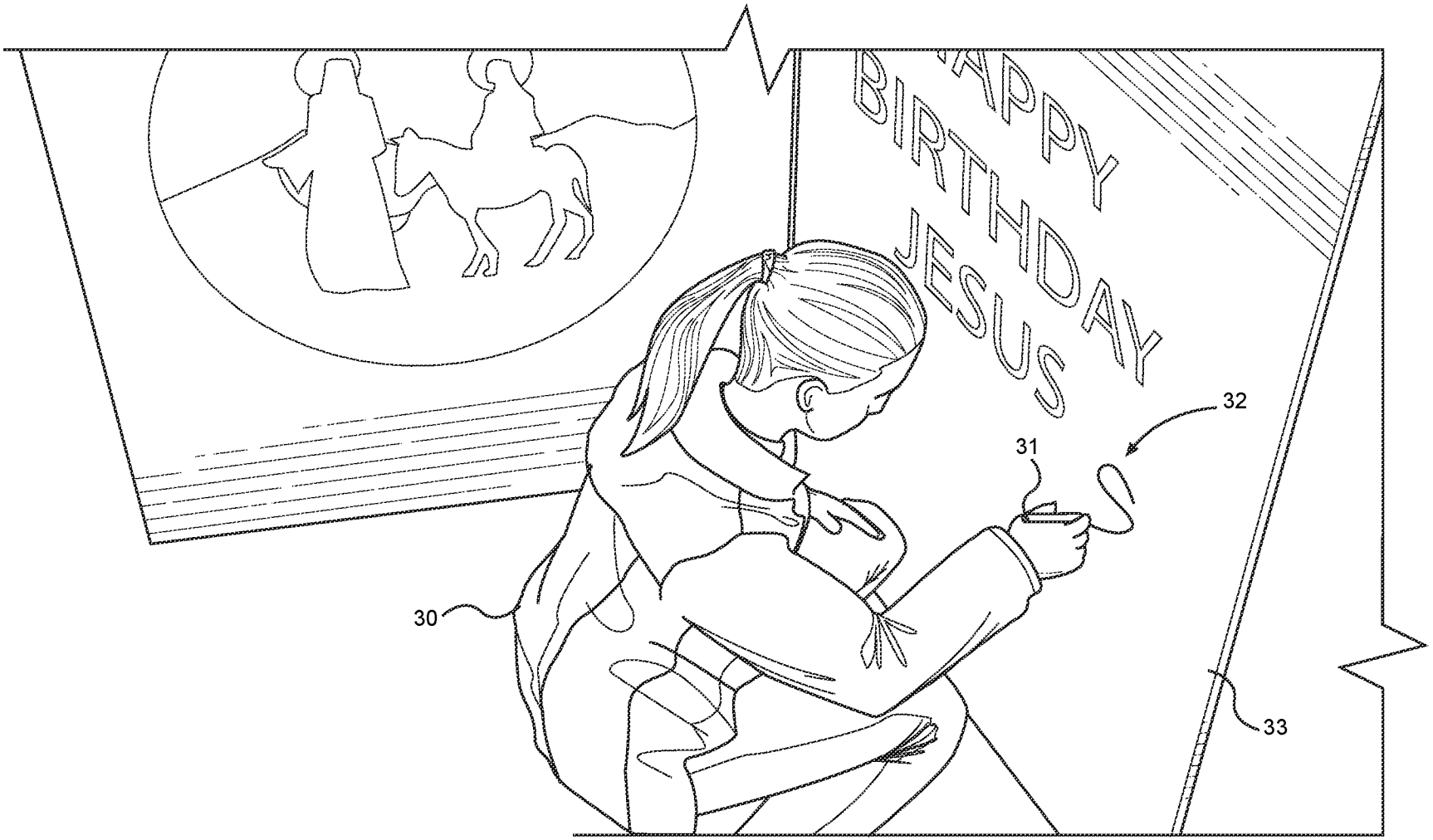
FIG. 5 shows a front perspective view of an embodiment of the foldable outdoor ornament in the open position with an individual writing on it.

Referring now to FIG. 5, there is shown a front perspective view of an embodiment of the foldable outdoor ornament in the open position, depicting an individual writing on the foldable outdoor ornament. In operation, the foldable outdoor ornament can be secured in a desired position for display in its unfolded configuration. An individual 30 may utilize a writing implement 31 to add temporary indicia 32 to the surfaces of the first and second panels. For example, an individual 30 may add a message, signature, or other markings to the panels, similar to how one would write in a birthday card or similar greeting card.

In some embodiments, particular materials may be utilized to facilitate the temporary indicia 32. As an example, in the shown embodiment, a front face of the first panel and a front face of the second panel include a high gloss vinyl coating adapted to provide a whiteboard surface for temporary markings made by a writing implement 31 such as erasable marker having an adhesive ink. In other embodiments, other surfaces may be provided that allow for markings to be made by individuals 30 with their own writing utensils 31. In this way, the foldable outdoor ornament can be further customized and updated overtime to improve the overall enjoyment it provides to the users and viewers of the foldable outdoor ornament.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foldable outdoor ornament comprising:

a first panel;

a second panel;

a fastener affixed to an interior surface of the first panel;

one or more hinges connecting an interior edge of the first panel to an interior edge of the second panel, wherein the first panel and the second panel are configured to move between a folded position and an open position;

a plurality of brackets affixed to a rear side of the first panel and a rear side of the second panel, each bracket of the plurality of brackets including an upper leg attached to one of the first panel or second panel and a lower leg extending perpendicularly outwardly from one of the rear side of the first panel or the rear side of the second panel, each lower leg including an aperture;

a plurality of stakes, wherein each stake of the plurality of stakes is removably secured within the aperture of the lower leg of one of the plurality of brackets;

a first pair of apertures disposed on the first panel and a second pair of apertures disposed on the second panel;

a first light string comprising a plurality of individual lights and having opposing ends extending through the first pair of apertures;

a second light string comprising a plurality of individual lights and having opposing ends extending through the second pair of apertures;

wherein the first light string extends along an upper edge of the first panel and the second light string extends along an upper edge of the second panel.

2. The foldable outdoor ornament of claim 1, wherein the first light string and the second light string are powered via a battery.

3. The foldable outdoor ornament of claim 1, wherein the fastener comprises an adhesive material.

4. The foldable outdoor ornament of claim 1, wherein the fastener comprises a clip.

5. The foldable outdoor ornament of claim 1, wherein the fastener comprises a hook.

6. The foldable outdoor ornament of claim 1, wherein the fastener comprises a magnet.

7. The foldable outdoor ornament of claim 1, wherein a front face of the first panel and a front face of the second panel comprises a high gloss vinyl coating adapted to provide a whiteboard surface for temporary markings made by an erasable marker having an adhesive ink.

8. The foldable outdoor ornament of claim 1, wherein the one or more hinges are configured to maintain a continuous gap between the first panel and the second panel when the first panel and the second panel are in the folded position.

9. The foldable outdoor ornament of claim 1, wherein each stake includes an upper angled member that extends outwardly and downwardly with respect to an elongated shaft having a pointed lower end.

10. The foldable outdoor ornament of claim 1, further comprising permanent indicia disposed on each of a front face of the first panel and a front face of the second panel.

11. The foldable outdoor ornament of claim 1, wherein the first panel and the second panel are rectangular.

12. The foldable outdoor ornament of claim 11, wherein the first panel and the second panel are identical in size.

* * * * *